United States Patent [19]

Mizukura et al.

[11] Patent Number: 4,576,911

[45] Date of Patent: Mar. 18, 1986

[54] SILVER HALIDE COLOR PHOTOGRAPHIC LIGHT-SENSITIVE MATERIAL

[75] Inventors: Noboru Mizukura; Noboru Fujimori; Kosaku Masuda; Shinji Yoshimoto; Noriki Tachibana; Eiichi Ueda, all of Hino, Japan

[73] Assignee: Konishiroku Photo Industry Co., Ltd., Tokyo, Japan

[21] Appl. No.: 646,960

[22] Filed: Sep. 4, 1984

[30] Foreign Application Priority Data

Sep. 5, 1983 [JP] Japan ..... 58-163731

[51] Int. Cl.[4] ..... G03C 7/38

[52] U.S. Cl. ..... 430/548; 430/554; 430/555; 430/558

[58] Field of Search ..... 430/552, 553, 554, 555, 430/556, 557, 558, 548

[56] References Cited

U.S. PATENT DOCUMENTS

| | | | |
|---|---|---|---|
| 4,388,404 | 6/1983 | Morigaki et al. | 430/548 |
| 4,416,978 | 11/1983 | Morigaki et al. | 430/548 |
| 4,464,463 | 8/1984 | Kojima et al. | 430/554 |
| 4,474,870 | 10/1984 | Yagihara et al. | 430/548 |

*Primary Examiner*—J. Travis Brown

*Attorney, Agent, or Firm*—Jordan B. Bierman

[57] ABSTRACT

A silver halide color photographic light-sensitive material containing a magenta dye-forming polymeric coupler.

16 Claims, No Drawings

SILVER HALIDE COLOR PHOTOGRAPHIC LIGHT-SENSITIVE MATERIAL

BACKGROUND OF THE INVENTION

1. Field of the Invention

The present invention relates to a silver halide color photographic light-sensitive material, and more particularly to a silver halide color photographic light-sensitive material which contains a high-maximum-density, high-speed and less-fogged magenta dye image-formable polymer coupler.

2. Description of the Prior Art

The formation of a color photographic image in the subtractive color process is carried out generally by color developing a silver halide photographic light-sensitive material with use of an aromatic primary amine developing agent in the presence of a cyan coupler, a magenta coupler and an yellow coupler, in which the silver halide particles of the exposed silver halide photographic light-sensitive material are reduced by the developing agent, and at the same time the produced oxidized product of the developing agent effects coupling reactions with these couplers to form a color photographic image consisting of cyan dye, magenta dye and yellow dye.

The above couplers may be contained in either the silver halide emulsion layers or a color developer liquid.

In general, in order to form an yellow dye, for example, acylacetanilide-type or benzoylmethane-type couplers are used; to form a magenta dye, pyrazolone-type, pyrazolobenzimidazole-type, cyanoacetophenone-type or indazolone-type couplers are chiefly used; and to form a cyan dye, phenol-type or naphthol-type couplers are mainly used. Those couplers to be used are required to have such various characteristics that they not only form dyes by color development but be excellent in the color developability as well as in the dispersibility and stability in the silver halide emulsion, and the dyes thus formed be stable against light, heat, moisture, etc., and have spectral absorption wavelength regions in desirable ranges.

In a multilayered color photographic light-sensitive material, in order to prevent the intermixing of the respective dyes to improve the color reproducibility, it is necessary to fix the respective couplers into the separate, appropriate layers.

There have been known various methods in the coupler nondiffusion process for this purpose.

One of these methods is the introduction of a long-chain aliphatic group into coupler molecules to prevent the diffusion of the coupler; the coupler is either rendered alkali-soluble to be added to an aqueous gelatin solution or dissolved into a high-boiling organic solvent and emulsifiedly dispersed into an aqueous gelatin solution. These couplers, however, have the drawback that they increase extremely the viscosity of the gelatin solution, or produce undesirable crystal deposits in the emulsion. And the high-boiling organic solvent, since it softens the emulsion layers, requires a large amount of gelatin, thus making it difficult to form thin emulsion layers.

On the other hand, there is a method which uses the latex of a polymer coupler that is obtained by the polymerization of a monomer coupler which is made nondiffusible and to whose molecules is introduced a polymerizable unsaturated bonding-containing group.

The polymer coupler is added in the latex form to a hydrophilic colloidal composition, and there are many methods for adding the coupler. Some of the methods are as follows: One method is such that a coupler monomer, if necessary, along with other copolymerizable components, is polymerized in the emulsion polymerization process to be directly form a latex, and the latex is then added to a silver halide emulsion; and another is such that a coupler monomer, if necessary, along with other copolymerizable components is polymerized in the solution polymerization process to thereby obtain a polymer coupler, the polymer coupler is dissolved into a solvent, and the solution is then dispersed into an aqueous gelatin solution to form a latex. The emulsion polymerization process of the former is described in U.S. Pat. Nos. 3,370,952 and 4,080,211. The process of the latter is described in, for example, U.S. Pat. No. 3,451,820. Such methods that a polymer coupler is added in the latex form to a hydrophilic colloidal composition have the following advantages over other methods:

That is, the latex-form polymer coupler can contain high-concentration coupler units and, since it contains no high-boiling solvent, permits the formation of a thinner layer, thus contributing to improvement of image sharpness. And, since it little increases the viscosity of an aqueous gelatin solution, it allows rapid, uniform emulsion coating. Further, the polymer coupler, because it is in the latex form, will in no case deteriorate the strength of the formed emulsion layer.

There are some examples of such the addition of a polymer coupler in the latex form to a silver halide emulsion. For example, U.S. Pat. Nos. 4,080,211 and 3,451,820, and British Pat. No. 1,247,688 described methods for the production of a 4-equivalent magenta polymer coupler latex; U.S. Pat. No. 3,767,412 describes cyan polymer coupler latexes; and U.S. Pat. No. 3,926,436 and West German Pat. No. 2,725,591 describe copolymer latexes with competing couplers. However, these polymer coupler latexes, although they have the aforementioned many excellent advantages, have the following questions yet to be solved for further improvements:

(1) The coupling reaction rate is so slow that no adequate dye density is obtained.
(2) Undesirable fog tends to be produced in color development.
(3) The solubility of the coupler monomer is so small that the polymerizability is extremely low.
(4) The resulting dye image is poor in the resistance against heat and moisture.

OBJECT OF THE INVENTION

It is therefore an object of the present invention to provide a silver halide color photographic light-sensitive material containing a magenta polymer coupler which is not only capable of forming a dye excellent in enabling the formation of a strong and thin layer as well as in the image sharpness due to the thin layer and resistance against heat and moisture but improved particularly in the maximum density as well as in the speed and fog.

The above object of the present invention can be accomplished by a silver halide color photographic light-sensitive material comprising a support having thereon a silver halide emulsion layer containing a magenta dye-formable polymer coupler containing repeating units having the following general formula:

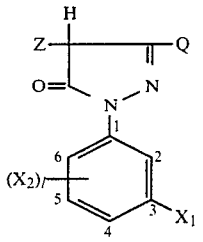

Formula [I]

wherein Q is an ethylenically unsaturated group or a group having an ethylenically unsaturated group; $X_1$ is a halogen atom; $X_2$ is a halogen atom that is bonded to a position selected from the second, fourth and fifth positions of the phenyl group; Z is a hydrogen atom or a radical which can be split off by the coupling reaction with the oxidized product of a color developing agent; and l is an integer of from 1 to 3, provided when the l is not less than 2, the not less than two $X_2$s are allowed to be either the same as or different from one another.

DETAILED DESCRIPTION OF THE INVENTION

The Q of Formula [I] is an ethylenically unsaturated group or a group having an ethylenically unsaturated group, and more preferably a group having the following general formula:

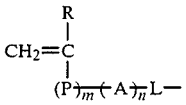

Formula [II]

wherein R is a hydrogen atom, a halogen atom or an alkyl group, and preferably a lower alkyl group having from 1 to 4 carbon atoms (such as, e.g., methyl, ethyl, t-butyl, etc.), the alkyl group being allowed to have a substituent; L is a divalent group such as —CONH—, —NHCONH— or —NH— (wherein the nitrogen atom is bonded to the pyrazolone ring); P is a —CONH— (wherein the nitrogen atom is bonded to the A of Formula [II]), —$SO_2$— or —COO— (wherein the oxygen atom is bonded to the A of Formula [II]), and more preferably —CONH— or —COO—; the A is a divalent group such as an alkylene group (preferably an alkylene group having from 1 to 10 carbon atoms) or a phenylene group, the alkylene group being allowed to be of a straight chain or branched chain, such as methylene, methylmethylene, dimethylene, decamethylene, or the like, the alkylene group and phenylene group each being allowed to have a substituent; and n and m each represents 0 or 1.

Preferred as Formula [II] are those in which the L is —CONH— or —NH—, the n is 1, the A is m-phenylene, the m is 1, the P is —CONH—, and the R is a lower alkyl group; and more preferably those in which the L is —CONH—, the n and m each is 0, and the R is a lower alkyl, particularly methyl.

The substituent for the alkylene or phenylene group represented by the A includes aryl groups (e.g., phenyl), nitro group, hydroxyl group, cyano group, sulfo group, alkoxy groups (e.g., ethoxy), acyloxy groups (e.g., acetoxy), acylamino groups (e.g., acetylamino), sulfonamido groups (e.g., methanesulfonamido), sulfamoyl groups (e.g., methylsulfamoyl), halogen atoms (e.g., fluorine, chlorine, bromine, etc.), carboxyl group, carbamoyl groups (e.g., methylcarbamoyl), alkoxycarbamoyl groups (e.g., methoxycarbamoyl, etc.), sulfonyl groups (e.g., methylsulfonyl, etc.), and the like. The alkylene or phenylene group as the A is allowed to have not less than two of these substituents, which are allowed to be either the same as or different from one another.

The radical, represented by the Z of Formula [I], which can be split off during the coupling reaction with the oxidized product of a color developing agent, to be more concrete, includes those having the following Formulas [IIIa], [IIIb] and [IIIc]:

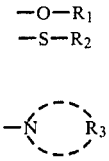

Formula [IIIa]
Formula [IIIb]
Formula [IIIc]

wherein $R_1$ and $R_2$ each is an alkyl, aryl or acyl group; $R_3$ is a group of non-metallic atoms necessary to form a 5-member or 6-member heterocyclic ring (e.g., imidazole ring, pyrazole ring, piperidine ring, morpholine ring, succinimido ring, triazole ring, etc.).

The following are the preferred examples of those represented by Formulas [IIIa], [IIIb] and [IIIc], but the present invention is not limited thereto.

(1) Examples of the —O—$R_1$ of Formula [IIIa]

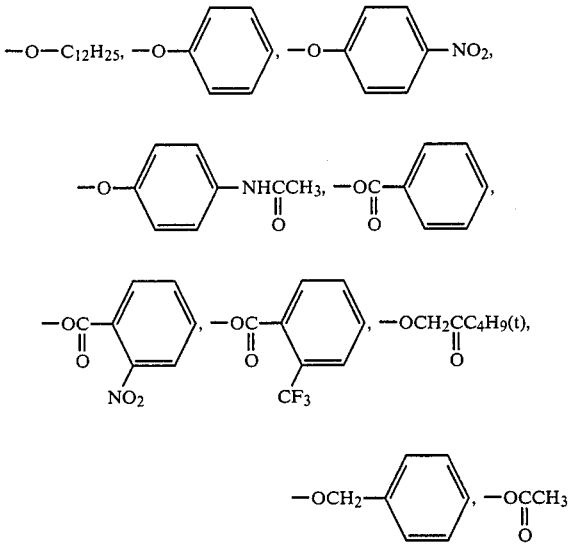

(2) Examples of the —S—$R_2$ of Formula [IIIb]

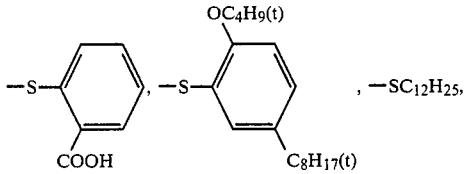

—$SC_{18}H_{37}$, —$SC_2H_5$, —$SCH_2CH_2OH$,

-continued

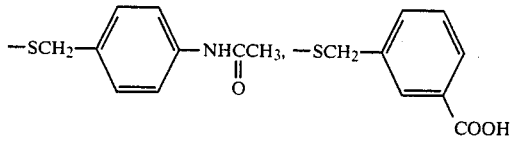

(3) Examples of the

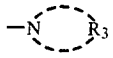

of Formula [IIIc]

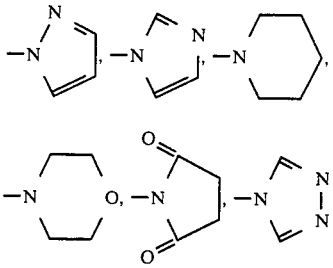

In Formula [I], the halogen atom represented by each of the $X_1$ and $X_2$ is e.g., fluorine, chlorine or bromine, and preferably chlorine atom. The $X_2$ is allowed to be bonded to a position selected from the second, fourth and fifth positions, and preferably to the second or fourth position. The l represents an integer of from 1 to 3, and preferably 1 or 2. If the l is not less than 2, the $X_2$s are allowed to be the same as or different from one another.

The following are typical examples of the coupler monomer represented by Formula [I]:

Exemplified Compounds:

(1)

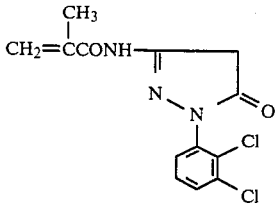

(2)

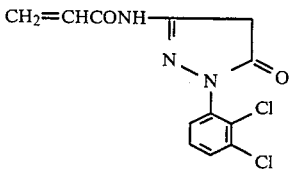

(3)

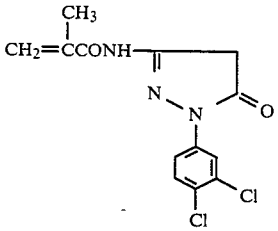

-continued (4)

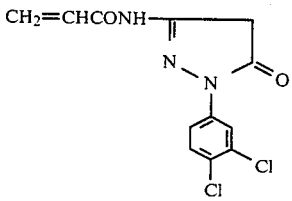

(5)

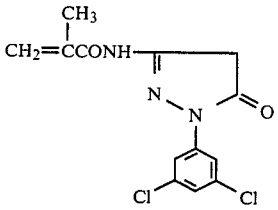

(6)

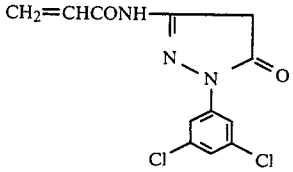

(7)

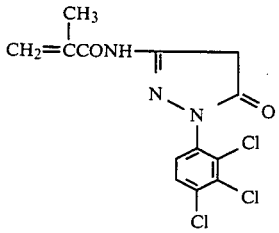

(8)

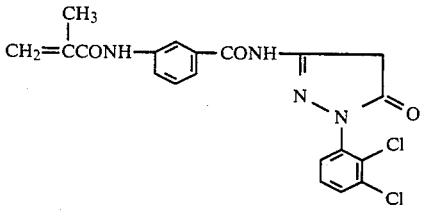

(9)

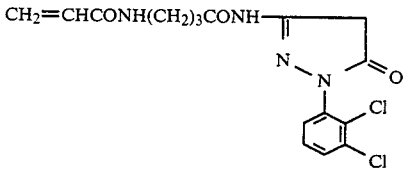

(10)

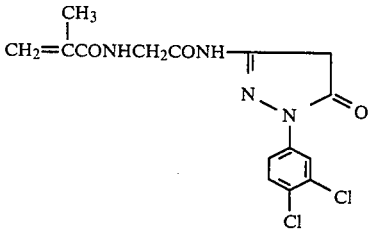

-continued (11)

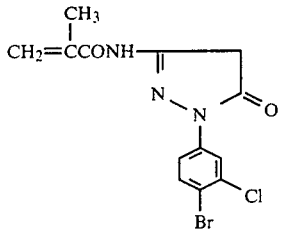

(12)

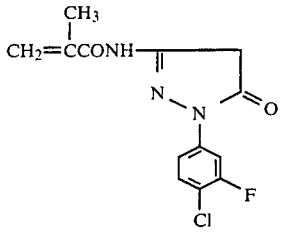

(13)

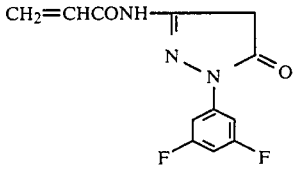

(14)

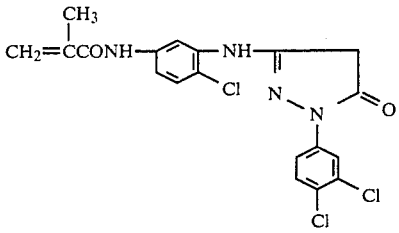

(15)

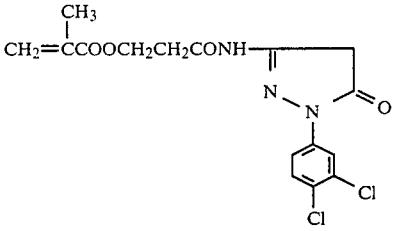

(16)

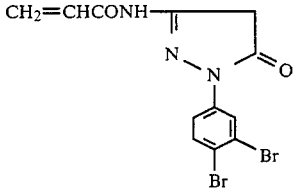

(17)

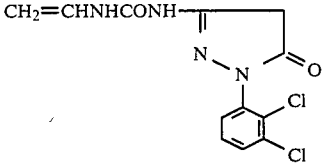

-continued (18)

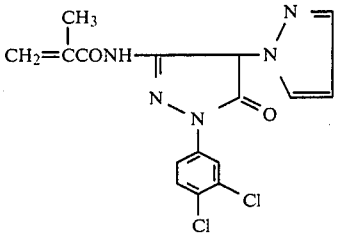

(19)

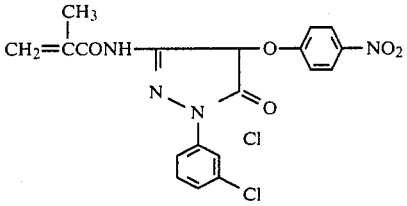

(20)

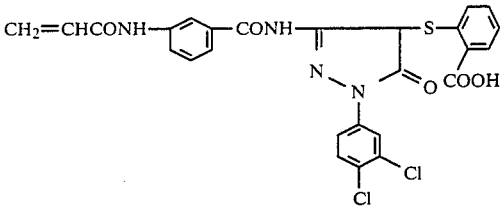

(21)

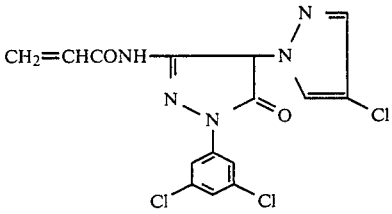

(22)

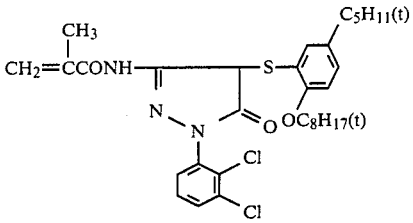

The monomer coupler represented by Formula [I] of the present invention can be synthesized by the reaction of a 3-amino-2-pyrazoline-5-one compound with an acrylic acid halide or methacrylic acid halide such as, e.g., acryloyl chloride, methacryloyl chloride, or the like. And the 3-acryloylamino compound may also be synthesized by dehydrochlorination, under a basic condition, of the 3-(β-halopropanoylamino) compound that is obtained by the reaction between a β-holopropinyl chloride and 3-amino-2-pyrazoline-5-one compound. These 3-amino-2-pyrazoline-5-one compounds usable in the present invention may by synthesized by the reaction of aromatic hydrazines with cyanocetates or β-ethoxy-β-iminopropionates as described in J. Amer. Chem. Soc., Vol. 66, p. 1849 (1944); Organic Synthesis, Vol. 28, p. 87 (1948); J. Amer. Chem. Soc., Vol. 65, p. 52 (1943); Journal of the Pharmaceutical Society of Japan Vol. 71, p. 1456 (1951) and Vol. 74, p. 726 (1954).

Typical examples of the synthesis of the foregoing coupler monomer of the present invention are given below:

SYNTHESIS EXAMPLE 1

Synthesis of 1-(2,3-dichlorophenyl)-3-methacryloylamino-2-pyrazoline-5-one (Exemplified Compound 1)

Forty grams (0.16 mole) of 1-(2,3-dichlorophenyl)-3-amino-2-pyrazoline-5-one, 30.4 ml (0.38 mole) of pyridine, and 4.0 ml of nitrobenzene were added to 600 ml of tetrahydrofuran, and to the mixture, cooled by ice, were added dropwise 39.2 g (0.38 mole) of methacryloyl chloride, and the liquid was stirred for 30 minutes, and then poured into 4 liters of water, extracted with use of ethyl acetate, then dried with use of anhydrous sodium sulfate, and then the solvent was distilled off under reduced pressure at a temperature of from 25° to 35° C. To the remaining oily substance were added 80 ml of ethanol and 80 ml of water and then a solution containing 22.4 g (0.56 mole) of sodium hydroxide. This mixture was stirred for 30 minutes at room temperature, and neutralized with acetic acid. The deposited crystals were filtrated, and recrystallized from methanol, whereby 32.4 g (64%) of Coupler Monomer (1) were obtained.

M.P. 186°–188° C.

Elementary analysis ($C_{13}H_{11}N_3O_2Cl_2$): Calculated C: 50.02%, H: 3.55%, N: 13.46%; Found C: 50.27%, H: 3.41%, N: 13.51%

SYNTHESIS EXAMPLE 2

Synthesis of 1-(3,4-dichlorophenyl)-3-methacryloylamino-2-pyrazoline-5-one (Exemplified Compound 3)

Twenty grams (0.08 mole) of 1-(3,4-dichlorophenyl)-3-amino-2-pyrazoline-5-one, 15.2 ml (0.19 mole) of pyridine and 2.0 ml of nitrobenzene were added to 300 ml of tetrahydrofuran. To this mixture, cooled by ice, were added dropwise 19.6 g (0.19 mole) of methacryloyl chloride. The liquid, after 30-minute stirring, was poured into 2 liters of water, extracted with use of ethyl acetate, and dried with use of anhydrous sodium sulfate, and then the solvent was distilled off under reduced pressure at a temperature of from 25° to 35° C. To the remaining oily substance were added 60 ml of ethanol and 60 ml of water, and further a solution of 11.2 g (0.28 mole) of sodium hydroxide dissolved into water. This mixture was stirred for 30 minutes at room temperature, and neutralized with acetic acid. The thus deposited crystals were filtrated, and recrystallized from ethanol, whereby 14.4 g (57%) of Coupler Monomer (3) were obtained. M.P. 212°–213° C.

Elementary analysis ($C_{13}H_{11}N_3O_2Cl_2$): Calculated C: 50.02%, H: 3.55%, N: 13.46%; Found C: 48.8%, H: 3.62%, N: 13.66%

SYNTHESIS EXAMPLE 3

Synthesis of 1-(3,5-dichlorophenyl)-3-acryloylamino-2-pyrazoline-5-one (Exemplified Compound 6)

Fourteen-point-six grams (0.06 mole) of 1-(3,5-dichlorophenyl)-3-amino-2-pyrazoline-5-one, 11.4 ml (0.14 mole) of pyridine and 1.2 ml of nitrobenzene were added to 200 ml of tetrahydrofuran. To this mixture, cooled by ice, were added dropwise 12.7 g (0.14 mole) of acryloyl chloride. The liquid, after 30-minute stirring, was poured into 2 liters of water, extracted with use of ethyl acetate, and dried with use of anhydrous sodium sulfate, and then the solvent was distilled off under reduced pressure at a temperature of from 25° to 35° C. To the remaining oily substance were added 60 ml of ethanol and 60 ml of water, and further a solution of 8.4 g (0.21 mole) of sodium hydroxide dissolved in water. The liquid was stirred for 30 minutes at room temperature, and neutralized, and the thus deposited crystals were filtrated, and recrystallized from ethanol, whereby 8.6 g (48%) of Coupler Monomer (6) were obtained.

M.P. 153°–156° C.

Elementary analysis ($C_{12}H_9N_3O_2Cl_2$): Calculated C: 48.35%, H: 3.04%, N: 14.09%; Found C: 48.39%, H: 3.21%, N: 13.88%

The polymer coupler of the present invention may be a homopolymer consisting of repeating units represented by Formula [I] alone, and may also be a copolymer obtained by the copolymerization of the unit with other copolymerizable comonomers. The preferred in the present invention are those copolymerized polymer couplers.

Examples of those copolymerizable comonomers include acrylic acid esters, methacrylic acid esters, crotonic acid esters, vinyl esters, maleic acid diesters, fumaric acid diesters, itaconic acid diesters, olefins, styrenes, and the like.

Referring more particularly to these comonomers, the acrylic acid ester includes methyl acrylate, ethyl acrylate, n-propyl acrylate, isopropyl acrylate, n-butyl acrylate, isobutyl acrylate, sec-butyl acrylate, amyl acrylate, hexyl acrylate, 2-ethyl-hexyl acrylate, octyl acrylate, tert-octyl acrylate, 2-chloroethyl acrylate, 2-bromoethyl acrylate, 4-chlorobutyl acrylate, cyanoethyl acrylate, 2-acetoxyethyl acrylate, dimethylaminoethyl acrylate, benzyl acrylate, methoxybenzyl acrylate, 2-chlorocyclohexyl acrylate, cyclohexyl acrylate, furfuryl acrylate, tetrahydrofurfuryl acrylate, phenyl acrylate, 5-hydroxypentyl acrylate, 2,2-dimethyl-3-hydroxypropyl acrylate, 2-methoxyethyl acrylate, 3-methoxybutyl acrylate, 2-ethoxyethyl acrylate, 2-isopropoxy acrylate, 2-butoxyethyl acrylate, 2-(2-methoxyethoxy)-ethyl acrylate, 2-(2-butoxyethoxy)ethyl acrylate, ω-methoxypolyethylene-glycol acrylate (the number of addition moles n=9), 1-bromo-2-methoxyethyl acrylate, 1,1-dichloro-2-ethoxyethyl acrylate, and the like.

Examples of the methacrylic acid ester include methyl methacrylate, ethyl methacrylate, n-propylmethacrylate, isopropyl methacrylate, n-butyl methacrylate, isobutyl methacrylate, sec-butyl methacrylate, amyl methacrylate, hexyl methacrylate, cyclohexyl methacrylate, benzyl methacrylate, chlorobenzyl methacrylate, octyl methacrylate, sulfopropyl methacrylate, N-ethyl-N-phenyl-aminoethyl methacrylate, 2-(3-phenylpropyloxy)ethyl methacrylate, dimethylaminophenoxyethyl methacrylate, furfuryl methacrylate, tetrahydrofurfuryl methacrylate, phenyl methacrylate, cresyl methacrylate, naphthyl methacrylate, 2-hydroxyethyl methacrylate, 4-hydroxybutyl methacrylate, triethylene-glycol monomethacrylate, dipropylene-glycol monomethacrylate, 2-methoxyethyl methacrylate, 3-methoxybutyl methacrylate, 2-acetoxyethyl methacrylate, 2-acetacetoxyethyl methacrylate, 2-ethoxyethyl methacrylate, 2-iso-propoxyethyl methacrylate, 2-butoxyethyl methacrylate, 2-(2-methoxyethoxy)ethyl methacrylate, 2-(2-ethoxyethoxy)-ethyl methacrylate, 2-(2-butoxyethoxy)-ethyl methacrylate, ω-methoxypolyethyleneglycol methacrylate (the number of addition moles n=6), and the like.

Examples of the vinyl ester include vinyl acetate, vinyl propionate, vinyl butyrate, vinyl isobutyrate, vinyl caproate, vinyl chloroacetate, vinyl methoxyacetate, vinyl-phenyl acetate, vinyl benzoate, vinyl salicylate, and the like.

Examples of the olefin include dicyclopentadiene, ethylene, propylene, 1-butene, 1-pentene, vinyl chloride, vinylidene chloride, isoprene, chloroprene, butadiene, 2,3-dimethylbutadiene, and the like.

The styrene includes, for example, styrene, methyl styrene, dimethyl styrene, trimethyl styrene, ethyl styrene, isopropyl styrene, chloromethyl styrene, methoxystyrene, acetoxystyrene, chlorostyrene, dichlorostyrene, bromostyrene, vinyl-methyl benzoate, and the like.

Examples of the crotonic acid ester are butyl crotonate, hexyl crotonate, and the like.

The itaconic acid diester includes, for example, dimethyl itaconate, diethyl itaconate, dibutyl itaconate, and the like.

The maleic acid diester includes, for example, diethyl maleate, dimethyl maleate, dibutyl maleate, and the like.

The fumaric acid diester includes, for example, diethyl fumarate, dimethyl fumarate, dibutyl fumarate, and the like.

Other examples of the comonomer are the following compounds: Acylamides such as, e.g., acrylamide, methyl acrylamide, ethyl acrylamide, propyl acrylamide, butyl acrylamide, tert-butyl acrylamide, cyclohexyl acrylamide, benzyl acrylamide, hydroxymethyl acrylamide, methoxyethyl acrylamide, dimethylaminoethyl acrylamide, phenyl acrylamide, dimethyl acrylamide, diethyl acrylamide, β-cyanoethyl acrylamide, and the like; allyl compounds such as, e.g., allyl acetate, allyl caproate, allyl laurate, allyl benzoate, and the like; vinyl ethers such as, e.g., methyl-vinyl ether, butyl-vinyl ether, hexylvinyl ether, methoxyethyl-vinyl ether, dimethylaminoethyl-vinyl ether, and the like; vinyl ketones such as, e.g., methyl-vinyl ketone, phenyl-vinyl ketone, methoxyethyl-vinyl ketone, and the like; vinyl heterocyclic compounds such as, e.g., vinyl pyridine, N-vinyl-imidazole, N-vinyl-oxazolidone, N-vinyl-triazole, N-vinyl-pyrolidone, and the like; glycidyl esters such as, e.g., glycidyl acrylate, glycidyl methacrylate, and the like; unsaturated nitriles such as, e.g., acrylonitrile, methacrylonitrile, and the like; multifunctional monomers such as, e.g., divinyl benzene, methylene-bisacrylamide, ethyleneglycol dimethacrylate, and the like.

Further examples of the comonomer are acrylic acid, methacrylic acid, itaconic acid, maleic acid; monoalkyl itaconates such as, e.g., monomethyl itaconate, monoethyl itaconate, monobutyl itaconate, etc.; monoalkyl maleates such as, e.g., monomethyl maleate, monoethyl maleate, monobutyl maleate, etc.; citraconic acid, styrene-sulfonic acid, vinylbenzyl-sulfonic acid, vinyl-sulfonic acid; acryloyloxyalkyl-sulfonic acids such as, e.g., acryloyloxymethyl-sulfonic acid, acryloyloxyethyl-sulfonic acid, acryloyloxypropyl-sulfonic acid, etc.; methacryloyloxyalkyl-sulfonic acids such as, e.g., methacryloyloxymethyl-sulfonic acid, methacryloyloxyethyl-sulfonic acid, methacryloyloxypropyl-sulfonic acid, etc.; acrylamidoalkyl-sulfonic acids such as, e.g., 2-acrylamido-2-methylethane-sulfonic acid, 2-acrylamido-2-methylpropane-sulfonic acid, 2-acrylamido-2-methylbutane-sulfonic acid, etc.; methacrylamidoalkyl-sulfonic acids such as, e.g., 2-methacrylamido-2-methylethane-sulfonic acid, 2-methacrylamido-2-methylpropane-sulfonic acid, 2-methacrylamido-2-methylbutane-sulfonic acid, etc.; acryloyloxyalkyl phosphates such as, e.g., acryloyloxyethyl phosphate, 3-acryloyloxypropyl-2-phosphate, etc.; methacryloyloxylalkyl phosphates such as, e.g., methacryloyloxyethyl phosphate, 3-methacryloyloxypropyl-2-phosphate, etc.; and the like. These acids are allowed to be either alkaline-metallic (e.g., Na, K, etc.) or ammonium-ionic salts. Still further comonomers usable in the invention are those cross-linkable monomers as described in U.S. Pat. Nos. 3,459,790, 3,438,708, 3,554,987, 4,215,195 and 4,247,673; Japanese Patent Publication Open to Public Inspection (hereinafter referred to as Japanese Patent O.P.I. Publication) No. 205735/1982; and the like. Examples of such cross-linkable monomers are N-(2-acetacetoxyethyl)-acrylamide, N-{2-(2-acetacetoxyethoxy)-ethyl}acrylamide, and the like.

Among these comononers those comonomers suitably usable in respect of the hydrophilicity, oleophilicity, and copolymerizability of the comonomer, the color developability of the resulting polymer coupler, and the color tone of the produced dye, include acrylates, methacrylates, maleates, acrylamides, and methacrylamides.

These comononers may be used in combination of two or more of them; for example, in the combination of n-butyl acrylate and methyl methacrylate, styrene and N-{2-(2-acetacetoxyethoxy)ethyl}acrylamide, tert-butyl-acrylate and methyl methacrylate, or the like.

The polymer coupler of the present invention is to be a copolymer, preferably one containing the repeating units represented by Formula [I] accounting for 40 to 70% by weight of the whole, and more preferably one in which the proportion by weight of the repeating units represented by Formula [I] to the copolymer is approximately 1:1.

The magenta polymer coupler of the present invention may be produced either by the emulsion polymerization method or in the manner that a oleophilic polymer coupler obtained by the polymerization of a monomer coupler is dissolved in an organic solvent, and the solution is then dispersed in the latex form into an aqueous gelatin solution. The emulsion polymerization method may be carried out as described in U.S. Pat. Nos. 4,080,211, and 3,370,952, while the method of dispersing the oleophilic polymer coupler in the latex form into an aqueous gelatin solution may be performed as described in U.S. Pat. No. 3,451,820.

These methods may also be applied to the formation of a homopolymer as well as of a copolymer. For the latter, the comonomer used should be a liquid comonomer, which, for the emulsion polymerization, serves as a solvent for a solid monomer at normal temperature.

For the emulsion polymerization and solution polymerization of the magenta polymer coupler of the invention, a water-soluble polymerization initiator and a oleophilic polymerization initiator are used, respectively. The usable water-soluble polymerization initiator includes persulfates such as, e.g., potassium persulfate, ammonium persulfate, sodium persulfate, etc.; water-soluble azo compounds such as, e.g., sodium 4,4'-azobis-4-cyanovalerate, 2,2'-azobis(2-amidinopropane)-hydrochloride, etc.; and hydrogen peroxide. The oleophilic polymerization initiator usable for the solution polymerization includes oleophilic azo compounds such as, e.g., azobis-isobutyronitrile, 2,2'-azobis(2,4-dimethylvaleronitrile), 2,2'-azobis(4-methoxy-2,4-dimethylvaleronitrile), 1,1'-azobis(cyclohexanone-1-carbonitrile), etc.; and oleophilic peroxides such as, e.g., benzoyl peroxide, lauryl peroxide, diisopropylperoxydicarbonate, di-tert-butyl peroxide, etc.

Those usable as the emulsifying agent for the emulsion polymerization method include surface active agents, high molecular protective colloids and copolymerization emulsifying agents. As the surface active agent there may be used aninonic surfactants, nonionic surfactants, cationic surfactants and amphoteric surfactants, which are all known to those skilled in the art. Examples of the anionic surfactant are soaps, sodium dodecylbenzene-sulfonate, sodium lauryl-sulfonate, sodium dioctylsulfosuccinate, and sulfates of nonionic surfactants. Examples of the nonionic surfactant are polyoxyethylenenonylphenyl ether, polyoxyethylenestearate, polyoxyethylenesorbitanmonolaurate, polyoxyethylene-polyoxypropylene block copolymer, and the like. Examples of the cationic surfactant are alkylpyridium salts, tertiary amines, and the like. Examples of the amphoteric surfactant are dimethylalkylbetaines, alkylglycines, and the like. The high molecular protective colloid includes polyvinyl alcohols, hydroxyethyl cellulose, and the like. These protective colloids may be used alone as the emulsifying agent or in combination with other surface active agents. The kinds and functions of these surface active agents are described in Belgische Chemische Industrie, Vol. 28, pp. 16 to 20 (1963).

In order to disperse a oleophilic polymer coupler synthesized by the solution polymerization method in the latex form into an aqueous gelatin solution, the oleophilic polymer coupler is first dissolved into an organic solvent, and the solution is then dispersed in the latex form with the aid of a dispersing agent by means of an ultrasonic wave, colloid mill, and the like. The method of dispersing the oleophilic polymer coupler in the latex form into an aqueous gelatin solution is described in U.S. Pat. No. 3,451,820. The organic solvent for use in dissolving the oleophilic polymer coupler includes esters such as, e.g., methyl acetate, ethyl acetate, propyl acetate, etc.; alcohols, ketones, halogenated hydrocarbons, ethers, and the like. These organic solvents may be used alone or in combination of two or more of them.

The following are examples of the production of the polymer coupler of the present invention. However, the invention is not limited by the following examples.

Production of the Magenta Polymer Coupler Latex

PRODUCTION EXAMPLE 1

Production of oleophilic polymer coupler latex (A) from 1-(2,3-dichlorophenyl)-3-methacryloylamino-2-pyrazoline-5-one (1) and n-butyl acrylate A mixture of 10 g of Exemplified Coupler Monomer (1), 10 g of n-butyl acrylate and 120 ml of dioxane was stirred at 80° C. in a nitrogen gas flow. To the mixture was added 0.36 g of azobis-isobutyronitrile dissolved in 4 ml of dioxane, and the reaction of the mixture took place for six hours. The dioxane solution was added dropwise to two liters of water, and the thus deposited solid was filtrated, then washed with water, and then dried, whereby 17.2 g (86%) of a oleophilic polymer coupler were obtained. The percentage of the coupler monomer (1) contained in the copolymer composition of this polymer coupler according to elementary analysis (nitrogen analysis) was 49.2%.

Ten grams of the above polymer coupler were dissolved into 30 ml of ethyl acetate. To this solution was added a mixture liquid of 6 ml of an aqueous 10% sodium laurylsulfate solution and 100 ml of an aqueous 5% by weight gelatin solution, and then the mixture was subjected to ultrasonic dispersion, and after that the ethyl acetate was distilled off under reduced pressure, whereby Latex (A) of the polymer coupler was obtained.

PRODUCTION EXAMPLE 2

Production of oleophilic polymer coupler latex (B) from 1-(3,4-dichlorophenyl)-3-methacryloylamino-2-pyrazoline-5-one (3), n-butyl acrylate and methyl acrylate A mixture of 10 g of Exemplified Coupler Monomer (3), 5 g of n-butyl acrylate, 5 g of methyl acrylate and 120 ml of dioxane was stirred at 80° C. in a nitrogen gas flow. To this mixture was added 0.36 g of azobis-isobutyronitrile dissolved in 4 ml of dioxane, and the reaction of the mixture took place for six hours. The dioxane liquid was added dropwise to two liters of water, and the thus deposited solid was filtrated, washed with water, and then dried, whereby 16.8 g (84%) of a polymer coupler were obtained. The percentage of the coupler monomer (3) contained in the copolymer composition of this polymer coupler according to elementary analysis (nitrogen analysis) was 53.6%.

The above polymer coupler was processed in the same manner as in Production Example 1, thereby producing Latex (B) of the polymer coupler.

PRODUCTION EXAMPLE 3

Production of oleophilic polymer coupler latex (C) from 1-(3,5-dichlorophenyl)-3-acryloylamino-2-pyrazoline-5-one (6) and n-butyl acrylate A mixture of 10 g of Exemplified Coupler Monomer (6), 10 g of n-butyl acrylate and 200 ml of tert-butanol was stirred in a nitrogen gas flow. To this mixture was added 0.36 g of azobis-isobutyronitrile dissolved in 10 ml of tert-butanol, and the reaction of the mixture took place for six hours. The tert-butanol solution was added dropwise to two liters of water, and the thus deposited solid was filtrated, washed with water, and then dried, whereby 15.8 g (79%) of a oleophilic polymer coupler were obtained. The percentage of the coupler monomer (6) contained in the coupler composition of this polymer coupler according to elementary analysis (nitrogen analysis) was 47.8%.

The above polymer coupler was processed in the same manner as in Production Example 1, thereby producing Latex (C) of the polymer coupler.

PRODUCTION EXAMPLE 4

Production of polymer coupler latex (A') from 1-(2,3-dichlorophenyl)-3-methacryloxylamino-2-pyrazoline-5-one (1) and n-butyl acrylate Ten grams of Exemplified Coupler Monomer (1) and 10 g of n-butyl acrylate were dissolved by heating into 200 ml of ethanol. 800 ml of an aqueous solution containing 2 g of sodium salt of oleylmethyltauride were stirred, heating to 95° C., in a nitrogen gas flow, and to this were added 20 ml of an aqueous solution containing 140 mg of potassium persulfate. Subsequently, to this solution was added dropwise spending one hour the foregoing ethanol solution. After completion of the dropping, the mixture was stirred, heating to a temperature between 95° and 85° C. Three hours later, to this were added 20 ml of an aqueous solution containing 60 mg of potassium persulfate, and the liquid was stirred for further three hours at the same temperature. After that, the ethanol and the unreacted n-butyl acrylate, as an azeotropic mixture, were distilled off.

The formed latex's solid concentration was 9.8% by weight, and the percentage of the coupler monomer (1) contained in the copolymer composition according to elementary analysis was 52.3%.

PRODUCTION EXAMPLE 5

Production of polymer coupler latex (B') from 1-(3,4-dichlorophenyl)-3-acryloylamino-2-pyrazoline-5-one (4) and ethyl acrylate Ten grams of Exemplified Coupler Monomer (4) and 10 g of ethyl acrylate were dissolved by heating into 200 ml of ethanol. 800 ml of an aqueous solution containing 2 g of sodium salt of oleylmethyltauride was stirred, heating to 95° C., in a nitrogen gas flow, and to this were added 20 ml of an aqueous solution containing 140 mg of potassium persulfate. Subsequently, to this were added dropwise spending an hour the foregoing ethanol solution. After completion of the dropping, the liquid was stirred, heating to a temperature between 95° and 85° C. Three hours later, to this were added 20 ml of an aqueous solution containing 60 mg of potassium persulfate, and the liquid was stirred for further three hours at the same temperature. After that the ethanol and the unreacted ethyl acrylate, as an azeotropic mixture with water, were distilled off.

The formed latex's solid concentration was 11.8% by weight. The percentage of the coupler monomer (4) contained in the copolymer composition according to elementary analysis was 54.5%.

PRODUCTION EXAMPLE 6

The foregoing coupler monomers were used to produce the following polymer coupler latexes in the same manners as in the copolymers of Production Examples-1, -2 and -3 (Production Method I) and as in Production Examples-4 and -5 (Production Method II).

| Production Ex. No. | Polymer coupler | Exemplified coupler monomer No. | Exemplified coupler monomer Q'ty (g) | Comonomer Kind | Comonomer Q'ty (g) | Coupler monomer content (% by wt) |
|---|---|---|---|---|---|---|
| | | Production Method I | | | | |
| 9 | D | (1) | 15 | BA | 5 | 76.8 |
| 10 | E | (1) | 10 | MA | 5 | 51.2 |
| | | | | BA | 5 | |
| 11 | F | (1) | 10 | EA | 10 | 53.0 |
| 12 | G | (2) | 10 | BA | 10 | 48.9 |
| 13 | H | (3) | 10 | BA | 10 | 50.7 |
| 14 | I | (3) | 10 | EA | 5 | 52.3 |
| | | | | BA | 5 | |
| 15 | J | (4) | 10 | BA | 10 | 51.5 |
| 16 | K | (5) | 10 | BA | 10 | 49.0 |
| 17 | L | (5) | 5 | BA | 15 | 24.4 |
| 18 | M | (5) | 10 | MA | 5 | 54.1 |
| | | | | BA | 5 | |
| 19 | N | (6) | 10 | EA | 10 | 50.3 |
| 20 | O | (7) | 10 | MMA | 5 | 51.3 |
| | | | | BA | 5 | |

-continued

| Production Ex. No. | Polymer coupler | Exemplified coupler monomer No. | Exemplified coupler monomer Q'ty (g) | Comonomer Kind | Comonomer Q'ty (g) | Coupler monomer content (% by wt) |
|---|---|---|---|---|---|---|
| 21 | P | (8) | 10 | MA | 5 | 47.6 |
| | | | | ST | 5 | |
| 22 | Q | (11) | 10 | HA | 10 | 50.3 |
| 23 | R | (14) | 10 | BA | 9 | 52.5 |
| | | | | AA | 1 | |
| 24 | S | (16) | 5 | BA | 10 | 26.4 |
| | | | | AAM | 5 | |
| | | Production Method II | | | | |
| 25 | C' | (1) | 10 | BA | 5 | 51.6 |
| | | | | MA | 5 | |
| 26 | D' | (1) | 15 | BA | 5 | 77.2 |
| 27 | E' | (1) | 10 | EA | 10 | 55.5 |
| 28 | F' | (2) | 10 | BA | 10 | 51.8 |
| 29 | G' | (3) | 10 | BA | 10 | 49.0 |
| 30 | H' | (3) | 10 | BA | 5 | 50.8 |
| | | | | MA | 5 | |
| 31 | I' | (3) | 5 | MA | 15 | 24.7 |
| 32 | J' | (4) | 10 | BA | 10 | 52.6 |
| 33 | K' | (5) | 10 | BA | 10 | 51.3 |
| 34 | L' | (5) | 10 | BA | 5 | 47.9 |
| | | | | MA | 5 | |
| 35 | M' | (5) | 10 | EA | 5 | 49.2 |
| | | | | BA | 5 | |
| 36 | N' | (6) | 10 | BA | 10 | 51.0 |
| 37 | O' | (7) | 10 | HA | 10 | 48.4 |
| 38 | P' | (8) | 10 | BA | 5 | 54.1 |
| | | | | MMA | 5 | |
| 39 | Q' | (8) | 10 | BA | 9 | 50.8 |
| | | | | AA | 1 | |
| 40 | R' | (11) | 10 | BA | 5 | 48.8 |
| | | | | St | 5 | |
| 41 | S' | (14) | 5 | BA | 10 | 26.3 |
| | | | | AAM | 5 | |
| 42 | T' | (16) | 10 | BMA | 10 | 56.3 |

In the above tables, the abbreviations in the comonomer column stand for the following compounds:

MA: Methyl acrylate
EA: Ethyl acrylate
BA: n-butyl acrylate
HA: n-hexyl acrylate
MMA: Methyl methacrylate
BMA: n-butyl methacrylate
AA: Acrylic acid
St: Styrene
AAM: Acrylamide Any of these magenta polymer coupler latexes of the present invention may be used alone or in a mixture with other generally known couplers which may be either the same dye image formable coupler as or different dye image formable coupler from the latex of the magenta polymer coupler of the invention. In addition, color-correction effect-having colored couplers, development inhibitor-releasing (DIR) couplers, or colorless couplers capable of forming a colorless product as a result of their coupling reaction may also be used in combination with the magenta polymer coupler of the invention. The miscible couplers are desirable to be nondiffusible couplers having a hydrophobic group called the "Ballast group" in their molecules, but also allowed to be those polymer couplers as described in U.S. Pat. Nos. 4,080,211, 3,163,625, 3,451,820, 4,215,195; British Pat. No. 1,247,688; Japanese Patent O.P.I. Publication Nos. 94752/1982, 28745/1983, 42044/1983 and 43955/1983, or sulfonic acid group- or carboxylic acid group-having water-soluble polymer couplers.

The combinedly usable magenta dye image formable couplers include those couplers as described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,455; West Ger. Pat. No. 1,810,464; West German OLS Pat. Nos. 2,408,665, 2,417,945, 2,418,959 and 2,424,467; Japanese Patent Examined Publication No. 6031/1965; Japanese Patent O.P.I. Publication Nos. 20826/1976, 58922/1977, 129538/1974, 74027/1974, 159336/1975, 42121/1977, 74028/1974, 60233/1975, 26541/1976 and 35122/1978.

The combinedly usable colored couplers include those as described in U.S. Pat. Nos. 3,418,062, 3,227,554, 3,733,201, 3,617,291, 3,703,375, 3,615,506, 3,265,506, 3,620,745, 3,632,345, 3,869,291, 3,642,485, 3,770,436 and 3,808,945; and British Pat. Nos. 1,201,110 and 1,236,767.

Any of the above colored couplers may be used in the manner that the coupler is dispersed into a hydrophilic colloid in any of those manners as described in U.S. Pat. Nos. 2,669,158, 2,304,940, 2,322,027, 2,772,163 and 2,801,171; and British Pat. No. 1,151,590, and the dispersed material is then incorporated by loading it into the latex of the polymer coupler of the present invention in any of those manners as described in Japanese Patent Examined Publication Nos. 30494/1973 and 39853/1976. The term "loading" used herein implies a condition that the hydrophobic magenta coupler is contained inside or deposited on the surface of the latex of the magenta polymer coupler of the invention.

However, it is not exactly known what mechanism brings about the "loading."

The magenta polymer coupler of the present invention may also be used in combination with any of those antistain agents as described in U.S. Pat. Nos. 2,336,327, 2,728,659, 2,336,327, 2,403,721, 2,701,197, 3,700,453, and the like, with any of those dye image stabilizers as described in British Pat. No. 1,326,889, U.S. Pat. Nos. 3,432,300, 3,698,909, 3,574,627, 3,573,050, 3,764,337, and the like, and with any of those DIR compounds as described in West German OLS Pat. Nos. 2,529,350, 2,448,063, 2,610,546, U.S. Pat. Nos. 3,928,041, 3,958,993, 3,961,959, 4,049,455, 4,052,213, 3,379,529, 3,043,690, 3,364,022, 3,297,445, 3,287,129, and the like.

The incorporation of any of these generally known couplers into a silver halide emulsion layer may be made by any of the prior-art methods. For example, the above coupler is dissolved into a high-boiling organic solvent whose boiling point is not less than 175° C., such as, e.g., tricresyl phosphate, dibutyl phthalate, or the like, or into a low-boiling solvent such as butyl acetate, butyl propionate, or the like, or into a mixture of these solvents. The coupler solution is mixed with an aqueous gelatin solution containing a surface active agent, then emulsified by means of a high-speed rotary mixer or colloid mill, and then added to a silver halide to thereby prepare a silver halide emulsion to be used in the present invention.

When incorporating the coupler into the silver halide emulsion to be used in this invention, it is added in a quantity of normally from 0.07 to 0.7 mole, and preferably from 0.1 to 0.4 mole per mole of the silver halide. If the coupler has an acid group such as of a sulfonic acid, carboxylic acid, or the like, it is incorporated in the form of an alkaline solution into the hydrophilic colloid.

The silver halide used in the silver halide emulsion layer of the invention includes those arbitrarily used for ordinary silver halide photographic emulsions, such as silver chloride, silver bromide, silver iodide, silver chlorobromide, silver iodobromide, silver chloroiodobromide, and the like.

The particles of these silver halides may be either coarse-grained or fine-grained. Their particle size distribution may be either narrower or wider. Their particle crystal may be either regular or twin, and those whose crystal is of an arbitrary [100] face-[111] face proportion may be used. Further, the crystal of these silver halide particles may be of either homogeneous structure from the inside through outside or heterogeneous structure stratified with the inside and the outside. In addition, these silver halides may be of either the type of forming a latent image mainly on the particle surface or the type of forming a latent image inside the particle. These silver halide particles may be prepared in any of the manners well-known to those skilled in the art.

The silver halide emulsion used in this invention is desirable to be free of water-soluble salts, but one with the salt unremoved is also usable. Further, two or more different emulsions prepared separately may be mixed to be used.

As the binder for the silver halide emulsion layer of the present invention there may be used conventionally known materials; for example, gelatin; gelatin derivatives such as phenylcarbamylated gelatin, acylated gelatin, phthalated gelatin, and the like; high-molecular non-electrolytes such as polyvinyl alcohol, polyvinyl pyrrolidone, polyacrylamide etc.; acidic polymers such as alginates, polyacrylic acid salts, etc.; high-molecular amphoteric electrolytes such as polyacrylamides treated by Hoffman rearrangement reaction acrylic acid-N-vinylimidazole copolymer, etc.; cross-linked polymers such as those described in U.S. Pat. No. 4,215,195; and the like. The binder is allowed to contain dispersed hydrophobic high-molecular materials; for example, latexes such as polybutylacrylates, polyethylacrylates, and the like. These binder materials may be used, if necessary, in a compatible mixture of two or more of them.

A silver halide photographic emulsion prepared by dispersing the above silver halide particles into a binder solution can be sensitized by chemical sensitizers. The chemical sensitizers advantageously usable in combination in this invention are broadly classified into four groups: noble-metallic sensitizers, sulfur sensitizers, selenium sensitizers and reduction sensitizers.

The noble-metallic sensitizers usable include gold compounds and those compounds of ruthenium, rhodium, palladium, iridium, platinum, and the like.

In addition, where gold compounds are used, ammonium thiocyanate, sodium thiocyanate, etc., may be used in combination.

The sulfur sensitizers include active gelatin and sulfur compounds.

The selenium sensitizers include active and inert selenium compounds.

The reduction sensitizers include stannous salts, polyamines, bisalkylaminosulfides, silane compounds, iminoaminomethane-sulfinic acid, hydrazinium salts, and hydrazine derivatives.

Further, the silver halide can be optically sensitized to a desired wavelength region by use of such optical sensitizers as, for example, cyanine dyes such as monomethine dyes, trimethine dyes, or merocyanine dyes, which may be used alone or in combination.

The silver halide photographic light-sensitive material of the present invention may contain a stabilizer, development accelerator, hardener, surface active agent, antistain agent, lubricant, ultraviolet absorbing agent, formalin scavenger, and various other additives useful for ordinary photographic light-sensitive materials, in addition to the above-described additives.

The silver halide photographic light-sensitive material of the present invention may have arbitrarily such auxiliary layers as a protective layer, interlayers, filter layers, an antihalation layer, a backing layer, and the like, in addition to silver halide emulsion layers.

For the support, conventionally known materials such as plastic film, plastic-laminated paper, baryta paper, synthetic paper, and the like, may be used by selecting according to the purpose for which the light-sensitive material is used. These support materials are generally subjected to subbing treatment for enhancing their adherence to the photographic emulsion layer.

The thus composed silver halide photographic light-sensitive material of the present invention, after being exposed imagewise to light, is subjected to color development in various photographic processing manners. The preferred color developing solution contains an aromatic primary amine-type color developing agent as the principal component. The color developing agent is typified by p-phenylenediamine-type compounds, which include, for example, diethyl-p-phenylenediamine hydrochloride, monomethyl-p-phenylenediamine hydrochloride, dimethyl-p-phenylenediamine hydrochloride, 2-amino-5-diethylaminotoluene hydrochloride, 2-amino-5-(N-ethyl-N-dodecylamino)-toluene, 2-amino-5(N-ethyl-N-β-methanesulfonamidoethyl-)aminotoluene sulfate, 4-(N-ethyl-N-β-methanesulfonamidoethylamino)aniline, 4-(N-ethyl-N-β-hydroxyethylamino)aniline, 2-amino-5-(N-ethyl-β-methoxyethyl)aminotoluene, and the like. These color developing agents may be used alone or in combination of two or more of them, or, if necessary, in combination with a black-and-white developing agent such as hydroquinone, phenidone, or the like. Further, the color developing solution contains generally an alkaline agent such as, e.g., sodium hydroxide, ammonium hydroxide, sodium carbonate, sodium sulfite, or the like, and may also further contain various additives such as a halogenated alkaline metal such as, e.g., potassium bromide, or a development control agent such as, e.g., citrazinic acid.

The silver halide photographic light-sensitive material of the present invention is allowed to contain in the hydrophilic colloidal layers thereof the foregoing color developing agent as it is or in the form of the precursor thereof. The color developing agent precursor is a compound capable of producing a color developing agent under an alkaline condition, and includes Schiff's base-type precursors with aromatic aldehyde derivatives, polyvalent metallic ion complex precursors, phthalic acid imide derivative precursors, phosphoric acid imide derivative precursors, sugar-amine reaction product precursors, and urethane-type precursors. These aromatic primary amine color developing agent precursors are described in, e.g., U.S. Pat. Nos. 3,342,599, 2,507,114, 2,695,234 and 3,719,492; British Pat. No. 803,783; Japanese Patent O.P.I. Publication Nos. 135628/1978 and 79035/1979; and Research Disclosure Nos. 15159, 12146 and 19324.

The aromatic primary amine color developing agent or the precursor thereof should be added in a sufficient quantity for the formation of a satisfactory color image in its development. This quantity varies largely according to the kind of the light-sensitive material used, but it is used in the range of from about 0.1 mole to 5 moles, and preferably from about 0.5 mole to 3 moles per mole of the light-sensitive silver halide. These color developing agents or the precursors thereof may be used alone or in combination. The incorporation of any of these developing agents or the precursor thereof into the photographic light-sensitive material may be made by adding the developing agent or the precursor thereof in the form of a solution of it dissolved into an appropriate solvent such as water, methanol, ethanol, acetone, or the like; or in the form of an emulsifiedly dispersed liquid with use of a high-boiling solvent such as dibutyl phthalate, dioctyl phthalate, tricresyl phosphate, or the like; or coating into the latex of the polymer form as described in Research Disclosure 14850.

The exposed silver halide photographic light-sensitive material of the present invention, after being color-developed, is generally bleached and fixed, or bleach-fixed, and then washed. For the bleaching, various compounds are used as the bleaching agent. The preferred among those used as the agent are polyvalent metallic compounds such as of iron(II), cobalt(II), tin(II), etc. (particularly complex salts of these polyvalent metallic cations with organic acids, such as those metallic complex salts of aminopolycarboxylic acids such as ethylenediamine-tetraacetic acid, nitrilotriacetic acid, N-hydroxyethylethylenediamine-diacetic acid; malonic acid, tartaric acid, malic acid, diglycolic acid, dithioglycolic acid) and ferricyanates, dichromates, and the like. These compounds may be used alone or in combination.

The present invention will be illustrated further in detail by the following examples.

EXAMPLE 1

Each of the Polymer Coupler Latexes A, B, C, H and K of the present invention and Comparative Polymer Coupler Latexes 1, 2 and 3 that will be described hereinafter was added in a quantity containing $5\times10^{-3}$ moles of each appropriate coupler monomer unit to 100 g of a high-speed silver iodobromide emulsion containing $5\times10^{-2}$ moles of silver iodobromide and 10 g of gelatin, and this emulsion was coated on a cellulose triacetate film support so that the silver coating quantity is 2.4 g/m$^2$, and then dried, whereby stable coat layer-having silver halide color photographic light-sensitive material samples 1 to 8 were prepared.

These samples 1 to 8 each was exposed through an optical wedge to light in usual manner, and then processed in accordance with the following developing process steps:

| Processing Steps (at 38° C.) | Processing Time |
|---|---|
| Color developing | 3 min. & 15 sec. |
| Bleaching | 6 min. & 30 sec. |
| Washing | 3 min. & 15 sec. |
| Fixing | 6 min. & 30 sec. |
| Washing | 3 min. & 15 sec. |
| Stabilizing | 1 min. & 30 sec. |

The compositions of the processing liquids used in the respective processes are as follows:

| Color Developing solution: | |
|---|---|
| 4-amino-3-methyl-N—ethyl-N—(β-hydroxyethyl)-aniline sulfate | 4.75 g |
| Anhydrous sodium sulfite | 4.25 g |

-continued

| | |
|---|---|
| Hydroxylamine ½ sulfate | 2.0 g |
| Anhydrous potassium carbonate | 37.5 g |
| Sodium bromide | 1.3 g |
| Trisodium nitrilotriacetate, monohydrated | 2.5 g |
| Potassium hydroxide | 1.0 g |
| Water to make 1 liter. Use potassium hydroxide to adjust the pH to 10.0. | |
| Bleaching solution: | |
| Iron-ammonium ethylenediamine tetraacetate | 100.0 g |
| Diammonium ethylenediamine tetraacetate | 10.0 g |
| Ammonium bromide | 150.0 g |
| Glacial acetic acid | 10.0 ml |
| Water to make 1 liter. Use aqueous ammonia to adjust the pH to 6.0. | |
| Fixing solution: | |
| Aqueous 50% ammonium thiosulfate solution | 162.0 ml |
| Anhydrous sodium sulfite | 12.4 g |
| Water to make 1 liter. Use acetic acid to adjust the pH to 6.5. | |
| Stabilizing bath: | |
| Aqueous 37% formalin solution | 5.0 ml |
| Koniducks (manufactured by Konishiroku Photo Industry Co., Ltd.) | 7.5 ml |
| Water to make 1 liter. | |

The magenta dye image density of each of the processed samples was measured through a green filter too determine the fog, relative speed (S) and maximum density (Dmax). The obtained results are as given in Table 1.

In addition, the Comparative Polymer Coupler Latexes 1, 2 and 3 are of the following compositions: [Production Method I]

Comparative Polymer Coupler Latex 1:

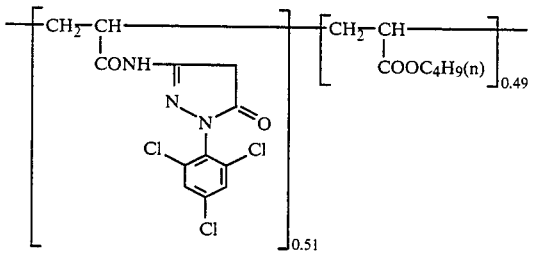

Comparative Polymer Coupler Latex 2: [Production Method I]

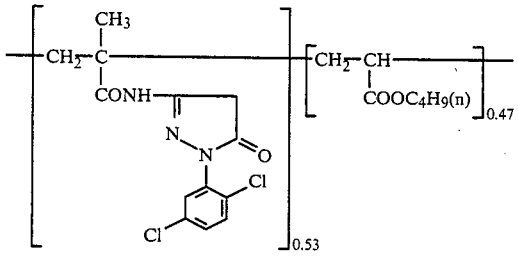

Comparative Polymer Coupler Latex 3: [Production Method I]

-continued

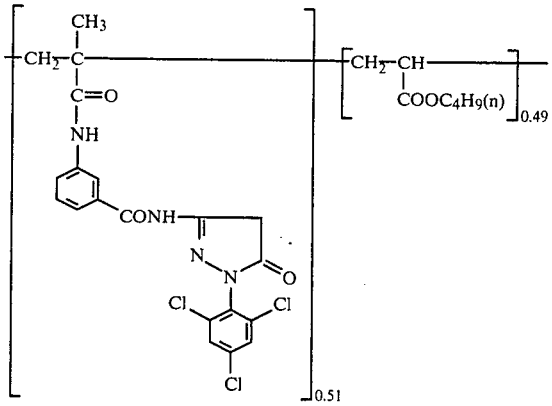

TABLE 1

| Sample No. | Polymer coupler | Fog | Relative speed (S)* | Maximum density (D max) |
|---|---|---|---|---|
| | Invention | | | |
| 1 | A | 0.06 | 120 | 2.6 |
| 2 | B | 0.05 | 107 | 2.8 |
| 3 | C | 0.06 | 111 | 2.5 |
| 4 | H | 0.07 | 109 | 2.7 |
| 5 | K | 0.06 | 118 | 2.6 |
| | Comparative | | | |
| 6 | 1 | 0.07 | 100 | 1.6 |
| 7 | 2 | 0.08 | 100 | 1.9 |
| 8 | 3 | 0.07 | 95 | 1.6 |

Note:
*Relative speed (S): Relative value of the reciprocal of an exposure necessary to obtain a density of fog plus 0.2.

As is apparent from Table 1, Samples 1 to 5, obtained by use of Polymer Coupler Latexes A, B, C, H and K of the present invention, exhibit higher maximum density and speed values and less fog values than those of Sample 6 to 8, obtained by use of Comparative Polymer Coupler Latexes 1, 2 and 3.

EXAMPLE 2

Each of the Polymer Coupler Latexes A', B', H' and K' of the present invention and Comparative Polymer Coupler Latexes 1' 2' and 3' was added in a quantity containing $5\times10^{-3}$ moles of each appropriate coupler monomer unit to 100 g of a high-speed silver iodobromide emulsion $5\times10^{-2}$ moles of silver halide and 10 g of gelatin, and this emulsion was coated on a cellulose triacetate film support so that the silver coating quantity is 2.4 g/m$^2$, and then dried, whereby stable coat layer-having silver halide color photographic light-sensitive material samples 9 to 15.

These samples each was exposed and then processed in the same manner as in Example 1.

In addition, the Comparative Polymer Coupler Latexes 1', 2' and 3' are of the following compositions:

Comparative Polymer Coupler Latex 1' [Production Method II]

-continued

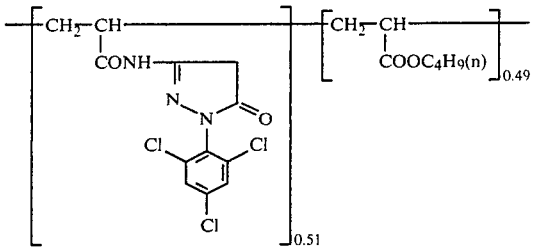

Comparative Polymer Coupler Latex 2' [Production Method II]

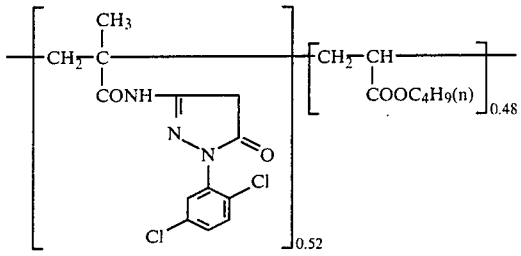

Comparative Polymer Coupler Latex 3' [Production Method II]

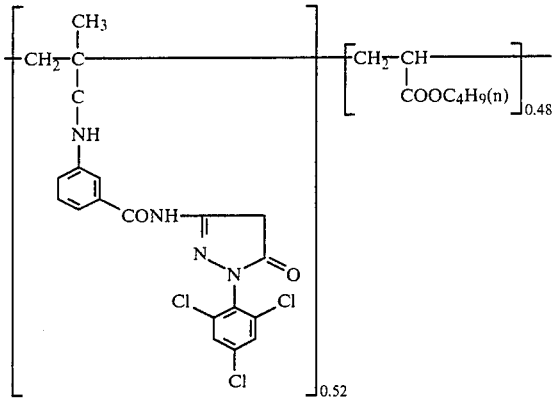

TABLE 2

| Sample No. | Polymer coupler | Fog | Relative speed (S)* | Maximum density (D max) |
|---|---|---|---|---|
| | Invention | | | |
| 9 | A' | 0.06 | 108 | 2.9 |
| 10 | B' | 0.07 | 112 | 2.7 |
| 11 | H' | 0.05 | 107 | 3.0 |
| 12 | K' | 0.06 | 110 | 2.8 |
| | Comparative | | | |
| 13 | 1' | 0.07 | 100 | 1.7 |
| 14 | 2' | 0.08 | 100 | 2.0 |
| 15 | 3' | 0.07 | 97 | 1.8 |

Note:
*Relative speed (S): Relative value of the reciprocal of an exposure necessary to obtain a density of fog plus 0.2.

As is apparent from Table 2, Samples 9 to 12, obtained by use of Polymer Coupler Latexes A', B', H' and K' of the present invention, are excellent in the maximum density and speed and have little fog as compared to those of Samples 13 to 15, obtained by use of Comparative Polymer Coupler Latexes 1', 2' and 3'.

EXAMPLE 3

Each of Polymer Coupler Latexes A, B, C, H and K of the present invention and Comparative Polymer Coupler Latexes 1, 2 and 3 in a quantity containing $7.5\times10^{-3}$ moles of each appropriate magenta dye formable coupler monomer unit was mixed with 100 g of a photographic emulsion containing $5\times10^{-2}$ moles of silver chlorobromide and 10 g of gelatin, and to this emulsion were added 10 ml of aqueous 0.2% sodium 2-hydroxy-4,6-dichloro-S-triazine solution as a hardening agent. The resulting emulsion was coated on a polyethylene-coated paper support so that the silver coating amount is 0.5 g/m$^2$, whereby silver halide color photographic light-sensitive material samples 16 to 23.

The samples each was exposed through an wedge in usual manner, and then processed in the following manner.

| Processing Steps | Processing Time |
|---|---|
| Color developing | 3 min. & 30 sec. |
| Bleach-fixing | 1 min. & 30 sec. |
| Washing | 2 min. |

| Color Developing solution: | |
|---|---|
| Benzyl alcohol | 15.0 ml |
| Sodium hexametaphosphate | 2.5 g |
| Anhydrous sodium sulfite | 1.85 g |
| Potassium bromide | 0.60 g |
| Borax | 39.10 g |
| Sodium borate ($Na_2B_4O_7.10H_2O$) | |
| N—ethyl-N—{2-(methanesulfonamido-ethyl)}-3-methyl-4-aminoaniline sulfate | 5.0 g |
| Water to make 1 liter. Use sodium hydroxide to adjust the pH to 10.3 | |
| **Bleach-Fixing bath:** | |
| Iron-ammonium ethylenediamine tetraacetate | 61.0 g |
| Diammonium ethylenediamine tetraacetate | 5.0 g |
| Ammonium thiosulfate | 124.5 g |
| Sodium metabisulfite | 13.3 g |
| Sodium sulfite | 2.7 g |
| Water to make 1 liter. Adjust the pH to 6.5. | |

The magenta dye image density of each of the samples processed under the above conditions was measured to determine the relative speed (S) and maximum density (Dmax). The obtained results are as given in Table 3.

In addition, the Comparative Polymer Coupler Latexes 1, 2 and 3 used in this test are of the same compositions as in Example 1.

TABLE 3

| Sample No. | Polymer coupler latex | Fog | Relative speed (S)* | Maximum density (D max) |
|---|---|---|---|---|
| | Invention | | | |
| 16 | A | 0.04 | 115 | 2.6 |
| 17 | B | 0.05 | 118 | 2.7 |
| 18 | C | 0.06 | 109 | 2.5 |
| 19 | H | 0.05 | 108 | 2.5 |
| 20 | K | 0.04 | 112 | 2.8 |
| | Comparative | | | |
| 21 | 1 | 0.08 | 100 | 1.5 |
| 22 | 2 | 0.07 | 98 | 1.9 |
| 23 | 3 | 0.07 | 94 | 1.6 |

Note:
*Relative speed (S): Relative value of the reciprocal of an exposure necessary to obtain a density of fog plus 0.2.

As is obvious from Table 3, Samples 16 to 20, obtained by use of the polymer coupler latexes of the invention exhibit very high maximum densities, high speed, and small fog as compared to those of Samples 21 to 23, obtained by use of Comparative Polymer Coupler Latexes 1, 2 and 3.

EXAMPLE 4

Each of Polymer Coupler Latexes A', B', H' and K' of the invention and Comparative Polymer Coupler Latexes 1', 2' and 3' in a quantity containing $7.5\times10^{-3}$ moles of each appropriate magenta dye formable coupler monomer unit was mixed with 100 g of photographic emulsion containing $5\times10^{-2}$ moles of silver halide and 10 g of gelatin, and to this emulsion were added 10 ml of aqueous 2% sodium 2-hydroxy-4,6-dichloro-S-triazine solution. The resulting emulsion was coated on a polyethylene-coated support, and then dried, whereby silver halide color photographic light-sensitive material samples were prepared. In addition, the silver coating amount of these samples was 0.5 g/m$^2$. These samples each were exposed through a wedge in usual manner, and then processed in the same manner as in Example 3.

The magenta dye image density of each sample was measured to determine the relative speed (S) and maximum density (Dmax). The obtained results are as given in Table 4. In addition, the Comparative Polymer Coupler Latexes 1', 2' and 3' used in this test are of the same compositions as in Example 2.

TABLE 4

| Sample No. | Polymer coupler latex | Fog | Relative speed (S)* | Maximum density (D max) |
|---|---|---|---|---|
| | Invention | | | |
| 24 | A' | 0.04 | 115 | 2.8 |
| 25 | B' | 0.05 | 107 | 2.6 |
| 26 | H' | 0.04 | 110 | 2.8 |
| 27 | K' | 0.05 | 109 | 2.9 |
| | Comparative | | | |
| 28 | 1' | 0.06 | 100 | 1.4 |
| 29 | 2' | 0.06 | 99 | 1.9 |
| 30 | 3' | 0.07 | 96 | 1.7 |

Note:
*Relative speed (S): Relative value of the reciprocal of an exposure necessary to obtain a density of fog plus 0.2.

As is apparent from Table 4, Samples 24 to 27, obtained by use of the polymer coupler latexes of the present invention, have very excellent maximum densities, high speeds and small fog as compared to those of Samples 28 to 30, obtained by use of the comparative polymer coupler latexes.

EXAMPLE 5

Each of Polymer Coupler Latexes A, B, C, A', B' and H' of the invention and Comparative Polymer Coupler Latexes 1, 2, 1' and 2' in a quantity containing $7.5\times10^{-3}$ moles of each appropriate magenta dye formable coupler monomer unit was mixed with 100 g of an emulsion containing $8.4\times10^{-2}$ moles of silver iodobromide and 10 g of gelatin. This emulsion was coated on a cellulose triacetate film support, and then dried, whereby silver halide color photographic light-sensitive material Samples 31 to 40 were prepared.

These samples each was exposed through a wedge in usual manner, and then processed in accordance with the following steps.

| Processing Steps (at 38° C.) | Processing Times |
|---|---|
| First developing | 6 minutes |
| First washing | 2 minutes |
| Reversal processing | 2 minutes |
| Color developing | 6 minutes |
| Control | 2 minutes |
| Bleaching | 6 minutes |
| Fixing | 4 minutes |
| Final washing | 4 minutes |
| Stabilizing | 30 minutes |

The compositions of the processing liquids used in the respective processes are as follows:

| | |
|---|---|
| **First Developing solution:** | |
| Aqueous 45% pentasodium nitrilo-N,N,N—trimethylene-sulfonate solution | 1.0 ml |
| Potassium sulfite, dihydrated | 35.0 g |
| Sodium bromide | 2.2 g |
| Sodium thiocyanate | 1.0 g |
| Potassium iodide | 4.5 mg |
| Potassium hydroxide | 4.5 g |
| Diethylene glycol | 12.0 ml |
| 1-phenyl-4-hydroxymethyl-3-pyrazolidone | 1.5 g |
| Anhydrous potassium carbonate | 14.0 g |
| Sodium hydrogencarbonate | 12.0 g |
| Potassium hydroquinone-sulfonate | 22.0 g |
| Water to make 1 liter. Adjust the pH to 9.6. | |
| **Reversal Processing solution:** | |
| Propionic acid | 12.0 ml |
| Anhydrous stannous chloride | 1.5 g |
| Paraminophenol | 0.5 mg |
| Sodium hydroxide | 5.0 g |
| Aqueous 45% pentasodium nitrilo-N,N,N—trimethylene-sulfonate solution | 15.0 ml |
| Water to make 1 liter. Adjust the pH to 5.8. | |
| **Color Developing solution:** | |
| Aqueous 45% pentasodium nitrilo-N,N,N—trimethylene-sulfonate solution | 5.0 ml |
| Phosphoric acid (85%) | 7.0 ml |
| Sodium bromide | 0.7 g |
| Potassium iodide | 30.0 mg |
| Potassium hydroxide | 20.0 g |
| Citrazinic acid | 1.3 g |
| 4-amino-N—ethyl-N—(β-methanesulfonamidoethyl)-m-toluidinesesquisulfate, monohydrated | 11.0 g |
| 1,8-hydroxy-3,6-dithiaoctane | 1.0 g |
| Water to make 1 liter. Adjust the pH to 11.7. | |
| **Controling solution:** | |
| Potassium sulfite | 15.0 g |
| Ethylenediamine-tetracetate | 8.0 g |
| α-Monothioglycerol | 0.5 ml |
| Water to make 1 liter. Adjust the pH to 6.2. | |
| **Bleaching solution:** | |
| Potassium nitrate | 25.0 g |
| Potassium bromide | 80.0 g |
| Iron(II)-ammonium ethylenediamine-tetracetate | 110.0 g |
| Hydrobromic acid (48%) | 30.0 ml |
| Ethylenediamine-tetracetic acid | 4.0 g |
| Water to make 1 liter. Adjust the pH to 5.7. | |
| **Fixing solution:** | |
| Ammonium thiosulfate | 55.0 g |
| Disodium ethylenediamine-tetracetate | 0.8 g |
| Sodium metabisulfite | 7.5 g |
| Sodium hydroxide | 1.5 g |
| Water to make 1 liter. Adjust the pH to 6.6. | |
| **Stabilizing bath:** | |
| Formalin (35%) | 6.0 ml |
| Koniducks (manufactured by Konishiroku Photo Industry Co., Ltd.) | 7.5 ml |
| Water to make 1 liter. | |

The magenta dye image density of each sample that was processed under the above conditions was measured to determine the fog, relative spped (S) and maximum density (Dmax). The obtained results are as given in Table 5. The Comparative Polymer Coupler Latexes 1, 2, 1′ and 2′ used are of the same compositions as in Examples 1 and 2.

TABLE 5

| Sample No. | Polymer coupler latex | Fog | Relative speed (S)* | Maximum density (D max) |
|---|---|---|---|---|
| | Invention | | | |
| 31 | A | 0.04 | 115 | 2.6 |
| 32 | B | 0.04 | 117 | 2.7 |
| 33 | C | 0.04 | 108 | 2.6 |
| 34 | A′ | 0.05 | 107 | 2.9 |
| 35 | B′ | 0.05 | 110 | 2.8 |
| 36 | H′ | 0.03 | 108 | 2.8 |
| | Comparative | | | |
| 37 | 1 | 0.06 | 100 | 1.6 |
| 38 | 2 | 0.05 | 95 | 2.0 |
| 39 | 1′ | 0.06 | 94 | 1.8 |
| 40 | 2′ | 0.07 | 98 | 2.1 |

Note:
*Relative speed (S): Relative value of the reciprocal of an exposure necessary to obtain a density of fog plus 0.2.

As is obvious from Table 5, these samples obtained by use of the polymer coupler latexes of the present invention exhibit very excellent maximum densities, high speeds and small fog as compared to those of the samples obtained by use of the comparative polymer coupler latexes.

EFFECT OF THE PRESENT INVENTION

The light-sensitive material containing the polymer coupler latex of the present invention has excellent photographic characteristics: high maximum density, high speed, and small fog.

What is claimed is:

1. A silver halide color photographic light-sensitive material which comprises a silver halide emulsion layer containing a magenta dye formable polymer coupler comprising a repeating unit having the formula:

Formula [I]

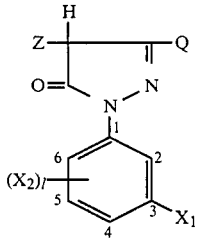

wherein Q is an ethylenically unsaturated group or a group having an ethylenically unsaturated group; $X_1$ is a halogen atom; $X_2$ is a halogen atom that is bonded to a position selected from the second, fourth and fifth positions of the phenyl group; Z is a hydrogen atom or a radical that can be split off by the coupling reaction with the oxidized product of a color developing agent; and l is an integer of from 1 to 3, provided if the l is not less than 2, said $X_2$s are allowed to be either the same as or different from one another.

2. The silver halide color photographic light-sensitive material of claim 1, wherein said ethylenically unsaturated group or said group having an ethylenically unsaturated group represented by said Q of Formula [I] is a group having the formula:

Formula [II]

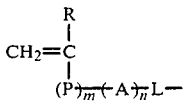

wherein R is a hydrogen atom, a halogen atom or an alkyl group; L is a divalent group of —CONH—, —NHCONH— or —NH— wherein the nitrogen atom is bonded to the pyrazolone ring; P is a divalent group of —CONH— wherein the nitrogen atom is bonded to the A of Formula [II], —$SO_2$— or —COO— wherein the oxygen atom is bonded to the A of Formula [II]; A is an alkylene or phenylene group; and m and n each is 0 or 1.

3. The silver halide color photographic light-sensitive material of claim 2, wherein said alkyl group represented by said R of Formula [II] is an alkyl group having from 1 to 4 carbon atoms; said divalent group represented by said P is —CONH— or —COO—; and said alkylene group represented by said A is an alkylene group having from 1 to 10 carbon atoms.

4. The silver halide color photographic light-sensitive material of claim 2, wherein said L is —CONH— or —NH—; said n is 1; said A is m-phenylene; said m is 1; said P is —CONH—; and said R is an alkyl group, having from 1 to 4 carbon atoms.

5. The silver halide color photographic light-sensitive material of claim 2, wherein said L is —CONH—; said m and n each is 0; and said R is methyl group.

6. The silver halide color photographic light-sensitive material of claim 1, wherein said radical represented by said Z, which can be split off during the coupling reaction with the oxidized product of a color developing agent, is a group represented by one of the following Formulas [IIIa], [IIIb] and [IIIc]:

—O—$R_1$ Formula [IIIa]
—S—$R_2$ Formula [IIIb]

Formula [IIIc]

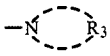

wherein $R_1$ and $R_2$ each is an alkyl, aryl or acyl group; $R_3$ is a group of nonmetallic atoms necessary to form a 5- or 6-member heterocyclic ring.

7. The silver halide color photographic light-sensitive material of claim 1, wherein said halogen atom represented by each of said $X_1$ and $X_2$ is a chlorine atom.

8. The silver halide color photographic light-sensitive material of claim 1, wherein said halogen atom represented by said $X_2$ is bonded to the second or fourth position of said phenyl group.

9. The silver halide color photographic light-sensitive material of claim 1, wherein said l is an integer of 1 or 2.

10. The silver halide color photographic light-sensitive material of claim 1, wherein said magenta dye formable polymer coupler having said repeating unit represented by Formula [I] is a copolymerized polymer coupler.

11. The silver halide color photographic light-sensitive material of claim 10, wherein said magenta dye formable polymer coupler having said repeating unit represented by Formula [I] comprises a comonomer, said comonomer being an acrylate, methacrylate, maleate, acrylic acid amide or acrylic acid.

12. The silver halide color photographic light-sensitive material of claim 10, wherein said repeating unit accounts for 40% to 70% by weight of the whole of said polymer coupler.

13. The silver halide coupler photographic light-sensitive material of claim 6, wherein said alkyl represented by $R_1$ and $R_2$ has 1 to 15 carbon atoms.

14. The silver halide color photographic light-sensitive material of claim 6, wherein said aryl represented by $R_1$ and $R_2$ is a phenyl group.

15. The silver halide color photographic light-sensitive material of claim 6, wherein said heterocyclic ring is one, selected from the group consisting of imidazole ring, pyrazole ring, piperidine ring, morpholine ring, succinimido ring, triazole ring.

16. The silver halide color photographic light-sensitive material of claim 1, wherein said polymer coupler has the molecular weight of 1,000–500,000.

* * * * *